US005990460A

United States Patent [19]

Petty et al.

[11] Patent Number: 5,990,460

[45] Date of Patent: Nov. 23, 1999

[54] VOLTAGE-DEPENDENT AUTOMATIC COOKING APPARATUS AND METHOD

[75] Inventors: Jonathan Scott Petty; Jennifer Lynn Tarplee, both of Cedar Rapids, Iowa

[73] Assignee: Amana Company, L.P., Amana, Iowa

[21] Appl. No.: 08/794,266

[22] Filed: Jan. 31, 1997

[51] Int. Cl.[6] ..... H05B 1/02

[52] U.S. Cl. ..... 219/497; 219/481; 219/506; 323/234

[58] Field of Search ..... 219/501, 506, 219/492, 497, 481, 499, 505; 323/319, 235, 236, 234

[56] References Cited

U.S. PATENT DOCUMENTS

| | | | |
|---|---|---|---|
| 4,317,977 | 3/1982 | Buck | 219/10.55 B |
| 4,340,807 | 7/1982 | Raskin et al. | 219/497 |
| 4,396,817 | 8/1983 | Eck et al. | 219/10.55 M |
| 4,420,668 | 12/1983 | Larson et al. | 219/10.55 B |
| 4,506,144 | 3/1985 | Hesford et al. | 219/497 |
| 4,901,506 | 2/1990 | Weyandt | 53/479 |
| 5,672,288 | 9/1997 | Tran | 219/502 |

OTHER PUBLICATIONS

Petty et al., U.S. application No. 08/769,616, Filed Dec. 18, 1996, Entitled "Oven with High Power Radiant Cooking Elements and Methods of Developing, Optimizing, Storing and Retrieving Recipes for the Operation of the Oven.".

*Primary Examiner*—Mark Paschall
*Attorney, Agent, or Firm*—Tobor, Goldstein & Healey

[57] ABSTRACT

A method and apparatus for changing an automatic cooking program in an electric oven is disclosed. A parameter of the cooking program, such as cooking time, is automatically altered in response to a property of the electricity supplying the oven, such as line voltage. The method and apparatus are particularly well suited for use in ovens utilizing halogen tungsten lamps as sources of heat.

17 Claims, 4 Drawing Sheets

34
TURN ON POWER.
33
36
DISPLAY READY MESSAGE.
38
SCAN KEYPADS FOR USER INPUT.
40
NUMBER (RECIPE) KEY PRESSED ?
NO
YES
42
CLEAR TEMPORARY MEMORY.
44
MEASURE PRESENT LINE VOLTAGE.
46
LOAD ORIGINAL RECIPE COOK TIME FROM PERMANENT MEMORY.
48
RATIO = ( -0.00625 * PRESENT LINE VOLTAGE ) + 2.5.
50
COOK TIME = ORIGINAL COOK TIME * RATIO.
DISPLAY COOK TIME AND RECIPE NAME.
52

FIG. 3
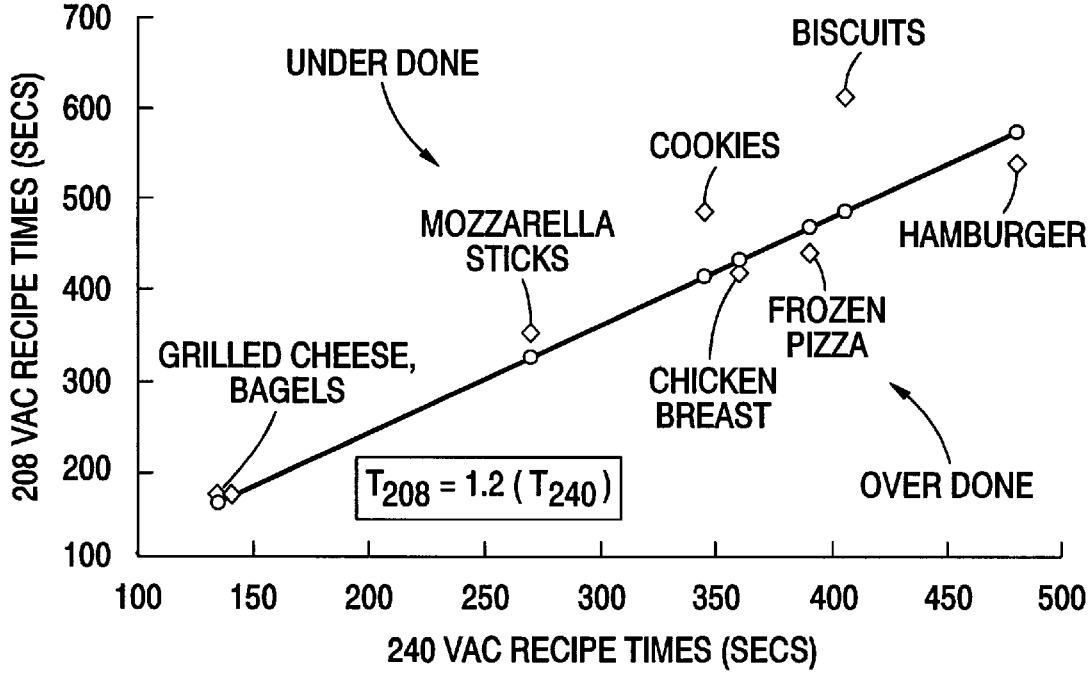
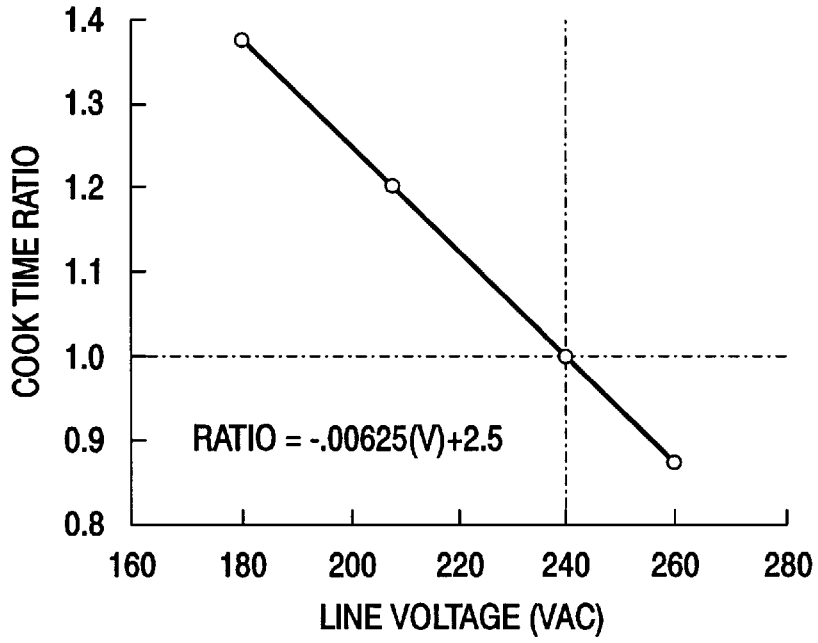
FIG. 4

VOLTAGE-DEPENDENT AUTOMATIC COOKING APPARATUS AND METHOD

TECHNICAL FIELD OF THE INVENTION

The present invention is directed generally to an oven control system, and in particular to an oven control system including the capability for controlling pre-programmed cooking procedures.

BACKGROUND OF THE INVENTION

Ovens are available which use high power radiant elements to cook. The high power radiant elements used are most commonly halogen tungsten lamps. The filaments of these lamps are low in mass and may be operated at very high temperatures (about 3000 Kelvin). These characteristics provide a means to cook food quickly with infrared radiation, while not requiring any pre-heating of the oven.

When cooking with infrared radiant energy, the rate at which food cooks depends upon the rate at which the energy that impinges on the food surface is conducted into the interior of the food. The rate in which the food cooks is also affected by the line voltage supplied to the oven. If, for instance, the line voltage is significantly below the voltage at which the oven is designed to operate (rated voltage), the lamp filament temperature will be lower and the infrared radiation available to cook decreased. A longer time will be required to cook a food item at this reduced voltage than if the same food was cooked at the oven's rated voltage. Conversely, an oven supplied with a line voltage higher than the rated voltage will cook food faster than if the line voltage is equal to the rated voltage.

The controls of an oven using high power radiant elements are greatly benefitted by the use of pre-programmed recipes, similar to those found on domestic microwave oven controls. This type of feature is especially important on an oven using high power radiant elements, as most end-users have no prior knowledge or experience cooking with an oven using halogen tungsten lamps.

These pre-programmed recipes are determined by cooking a wide variety of commonly cooked foods using particular sequences of radiant element power intensities and cooking times. These recipes are permanently stored in read-only-memory (ROM) of an electronic control microprocessor within the oven. The recipes may be recalled at any time by the end-user by pressing a particular key on a keypad on the oven.

A problem arises when the oven is used in a location where the supply voltage varies greatly from the oven's rated voltage (typically 240 VAC). Typically, a household supply for a range product of this power is 240 VAC, but can vary as much as +/−20 VAC. Moreover, in many locations, such as in department stores where the oven maybe demonstrated, or in very large metropolitan areas, the typical supply voltage is 208 VAC. The use of the pre-programmed recipes under these varying voltage conditions may result in inconsistent cooking results, i.e. underdone and overdone food.

Inconsistencies in cooking results will make the end-user frustrated and not desire to continue to learn how to use this new cooking technology. Without a solution to this consistency problem, an oven using high intensity radiant elements will find a barrier in the marketplace based on end-user complaints.

Other appliances, such as electric ranges and cook tops are also affected by this line voltage variability, but to a lesser extent. Appliances of this type are typically temperature and not time regulated, are familiar to the user, and do not include pre-programmed recipes built into the controls. These factors negate effects of line voltage variation.

The present invention is directed to a cooking method and apparatus which solves one or more of the above noted problems.

SUMMARY OF THE INVENTION

According to a first aspect of the present invention, an oven includes an electric cooking element and a power supply line adapted to be connected to a source of electricity. The power supply line is arranged to supply electrical power to the electric cooking element. The oven further includes means for selecting an automatic cooking procedure, means for controlling the automatic cooking procedure, means for sensing a property of the electricity, and means for adjusting the automatic cooking procedure based on the sensed property of the electricity.

Preferably, in more detailed aspects of the present invention, the electric cooking element is a halogen tungsten lamp, the controlling means is an electronic control microprocessor, and the sensing means includes an analog voltage sensor and an analog-to-digital convertor. The sensed property may be voltage, current, or power. The automatic cooking procedure preferably includes a cooking time and the adjusting means includes means for altering the cooking time.

According to another aspect of the present invention, an oven comprises an electric cooking element and a power supply line adapted to be connected to a source of electricity. The power supply line is arranged to supply electrical power to the electric cooking element. The oven further includes a keypad for selecting an automatic cooking procedure, an electronic control microprocessor including a pre-programmed algorithm for controlling the automatic cooking procedure, and a voltage sensor for measuring the voltage of the electricity. The electronic control microprocessor is arranged to adjust the automatic cooking procedure based on the measured voltage of the electricity.

According to yet another aspect of the present invention, a method is provided for cooking with an oven having an electric cooking element, a power supply line arranged to be connected to a source of electricity for supplying electrical power to the electric cooking element, and an electronic control microprocessor. The method comprises the steps of: reading a user-selected pre-programmed cooking algorithm using the electronic control microprocessor; executing the pre-programmed cooking algorithm; and automatically adjusting a parameter of the pre-programmed cooking algorithm in response to a property of the electricity.

BRIEF DESCRIPTION OF THE DRAWINGS

These and other features and advantages of the present invention will become more apparent from a detailed consideration of the invention when taken in conjunction with the drawings in which:

FIG. 3 is a graph illustrating sample results achieved using the oven of FIG. 1; and, FIG. 4 is a graph illustrating the determination of a cooking time ratio scaling factor, which is used by the program of FIG. 2 as a function of line voltage.

DETAILED DESCRIPTION

Figure 1A:
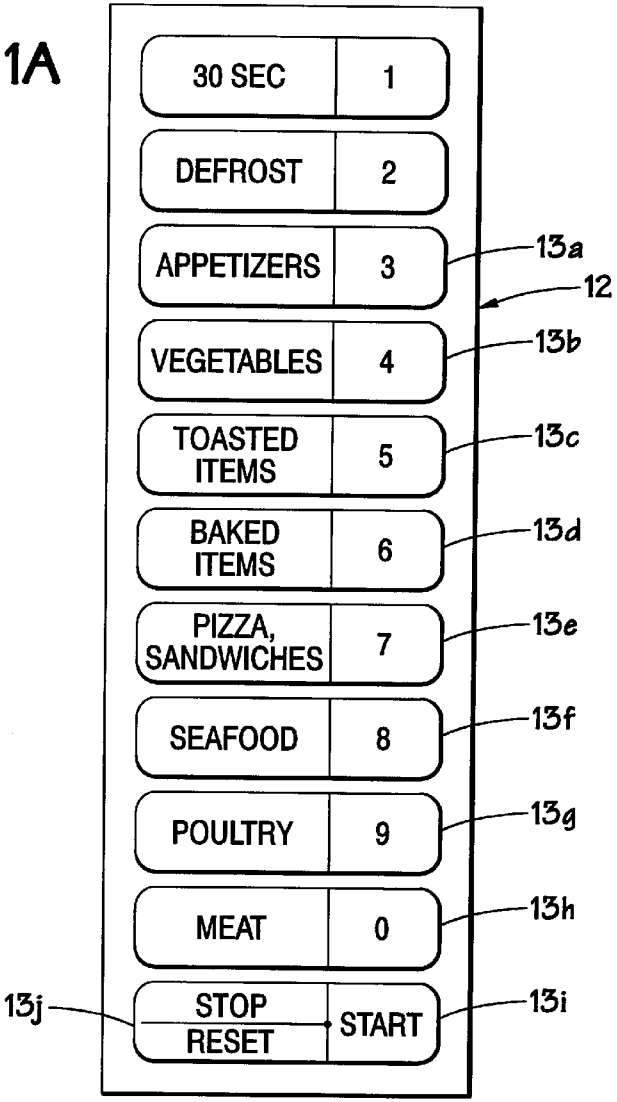
FIG. 1A is a front view of a portion of a preferred keypad arrangement for the oven of FIG. 1.
Figure 1:
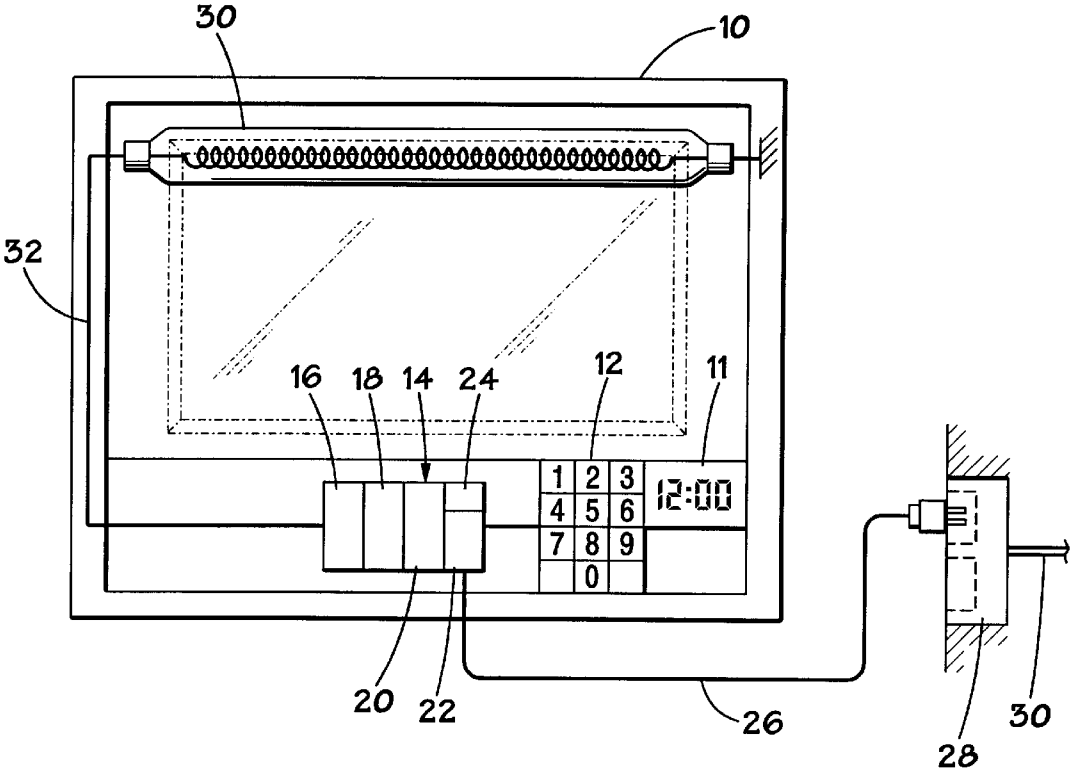
FIG. 1 is a schematic view of an oven in accordance with of the present invention.

As shown in FIG. 1, an oven 10 includes a display screen 11 and a user keypad 12 for inputting commands to an electronic control microprocessor (ECM) 14. Such input commands may include the selection of a pre-programmed cooking procedure for any one of a number of types of food. The ECM 14 includes ROM and random access memory (RAM) modules 16 and 18, respectively, and a central processing unit (CPU) 20. The ECM 14 further includes a voltage sensor 22 having an analog-to-digital converter 24. The voltage sensor 22 is electrically connected to a power supply line 26 that provides power to the oven 10 from a local source of electricity 28. Electrical power is provided to the local source of electricity 28 by a power plant (not shown) via a transmission line 30.

The ECM 14 controls the amount of power supplied to a halogen tungsten lamp 30, that serves as a cooking element, by a wire 32.

Although the keypad 12 is shown with numbers only in FIG. 1, the keypad 12 may also desirably be provided with words or symbols which are more descriptive of the pre-programmed cooking procedures that may be selected. For example, as shown in FIG. 1A, the keypad 12 preferably includes a plurality of keys 13*a–h* for selecting preprogrammed recipes for cooking particular types of food, as well as a start key 13*i* for starting the oven 10 and a stop/reset key 13*j* for stopping and/or resetting the oven 10. When the user presses one of the keys 13*a–h*, a menu of recipes stored in the ROM module 16 is displayed on the display screen 11, for the food type associated with the key 13*a–h* that has been pressed. The user can scroll through a plurality of recipes for a given food type, for example pizza, by repeatedly pressing the key 13*e* associated with that food type. Also, the keypad 12 may be a switch type keypad, a capacitive keypad, or the like.

Figure 2:
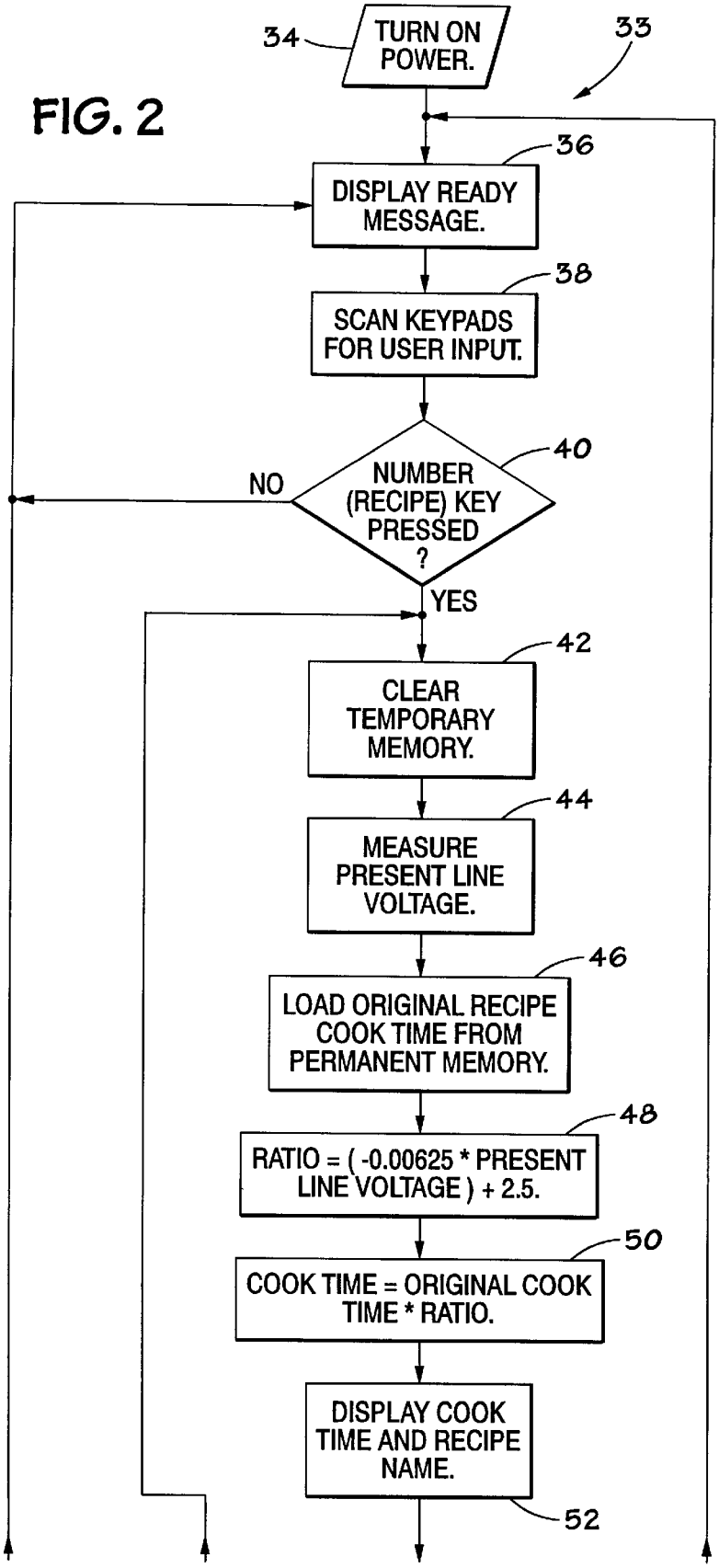
FIG. 2 is the upper portion of a flow diagram of a program which controls the oven of FIG. 1.
Figure 2A:
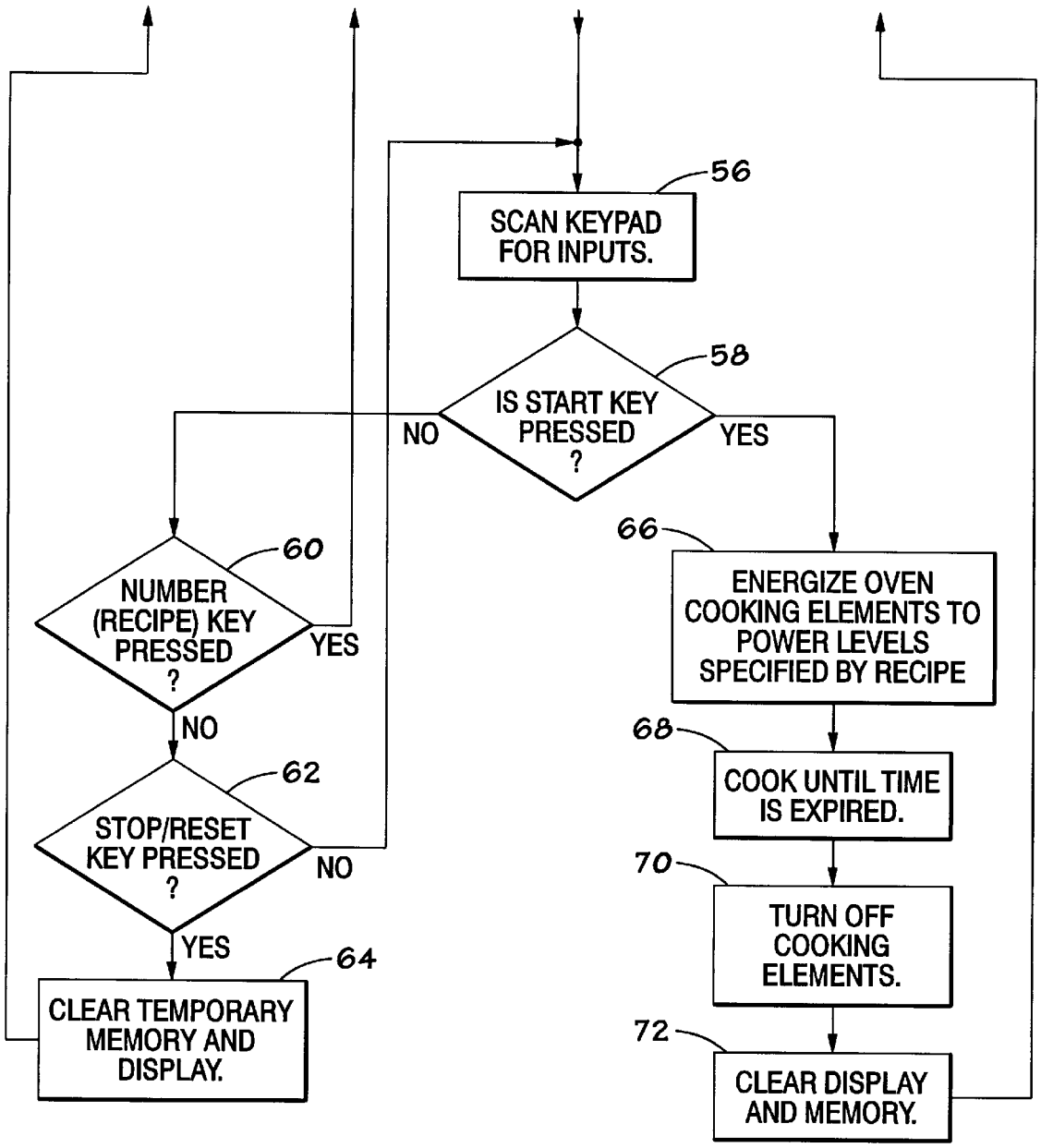
FIG. 2A is the lower portion of the flow diagram of FIG. 2.

FIGS. 2 and 2A illustrate an algorithm 33, that may be pre-programmed into the ROM module 16 or RAM module 18 and executed by the ECM 14 for carrying out a cooking method in accordance with the present invention. At a block 34, power is turned on in the oven 10 and a ready message is displayed on the display screen 11 at a block 36. At a block 38, the keypad 12 is scanned for user inputs. As indicated at a decision block 40, if none of the number keys 13*a–h* has been pressed, the algorithm 33 returns to the block 36, where a ready message is displayed on the display screen 11. If one of the number keys 13*a–h* is pressed, then temporary memory (RAM module 18) is cleared at a block 42.

At a block 44, a value for line voltage, $V_L$, is determined based upon the voltage measured by the voltage sensor 22. At a block 46, an original recipe cooking time, corresponding to key 13*a–h* that has been pressed, is loaded into temporary memory (RAM module 18) from permanent memory (ROM module 16). A cooking time ratio is calculated at a block 48. The cooking time ratio may be a linear or nonlinear function of the line voltage, although it is shown as a linear function in FIG. 2. At a block 50, the cooking time is calculated by multiplying the original cooking time by the cooking time ratio calculated in the block 48. At a block 52, the cooking time and recipe name are displayed on the display screen 11 and the algorithm 33 continues to a block 56 (FIG. 2), where the keypad 12 is again scanned for inputs. At a decision block 58, the algorithm 33 decides whether the start key 13*i* has been pressed. If the start key 13*i* has not been pressed, the algorithm continues to a decision block 60, where the algorithm 33 decides whether one of the number keys 13*a–h* has been pressed. If one of the number keys 13*a–h* has been pressed, the algorithm 33 returns to the block 42 (FIG. 2). If none of the number keys 13*a–h* has been pressed, the algorithm 33 continues to a decision block 62, where the algorithm 33 decides whether the stop/reset key 13*j* has been pressed. If the stop/reset key 13*j* has not been pressed, the algorithm 33 returns to the block 56. If the stop/reset key 13*j* has been pressed, the algorithm 33 continues to a block 64, where the temporary memory (RAM module 18) and the display screen 11 are cleared, after which the algorithm 33 returns to the block 36 (FIG. 2) where the ready message is displayed on the display screen 11.

Again referring to the decision block 58 (FIG. 2A), if the start key 13*i* has been pressed, the algorithm 33 continues to a block 66, where oven cooking elements, including the halogen tungsten lamp 30, are energized to power levels as specified by the selected recipe. At block 68, the oven 10 continues to cook the food until the cooking time, as calculated in the block 50, has expired. At a block 70, the cooking elements, including the halogen tungsten lamp 30, are turned off and at block 72 the display screen 11 and RAM module 18 are cleared. The algorithm 33 then returns to the block 36 (FIG. 2).

If desired, the user may override the pre-programmed algorithm using the keypad to control the power level before initiating the cooking procedure if, for example, satisfactory cooking results have not been achieved by a previous use of the pre-programmed algorithm for a particular type of food.

The cooking time ratio may also depend on one or more additional variables, such as the type of food that is to be cooked using the selected pre-programmed cooking procedure. In this case, the additional variable or variables would be used as additional inputs to the cooking time calculation.

The calculation of cooking time ratios is also applicable to proportionally adjust each stage of multiple-stage recipes as a function of line voltage. For example, suppose the total cooking time for a two-stage recipe is two minutes: for one minute, twenty seconds, an upper set of cooking elements is powered at a medium power level setting and a lower set of cooking elements is not powered; and for forty seconds, the upper set of cooking elements is not powered and the lower set of cooking elements is powered at a high power level setting. For such a recipe, the cooking time ratio would be applied to each of the two cooking stages to compensate for the magnitude of the line voltage.

Alternatively, the cooking time ratio could be stored as a look-up table in the ROM module 16. In such an arrangement, line voltage, as determined at block 44, could be used as an address into the look-up table and a cooking time ratio stored at that address could be read out of the look-up table. The cooking time ratio may also depend on one or more additional variables, such as the type of food that is to be cooked using the selected pre-programmed cooking procedure. In this case, a plurality of look-up tables, one for each value of the variable, is stored in the ROM module 16. Thus, the variable is used to select one of the look-up tables and the voltage determined at block 44 is used as an address to read out a cooking time ratio from the selected lookup table.

EXAMPLE

FIG. 3 shows the adjustment required for a variety of recipes developed at 240 VAC using a Domestic Amana Wave Oven™ powered by 208 VAC. A ratio of 1.2×(original cooking time) was used to increase the necessary amount of time for all food items. To improve the algorithm for those food items such as baked goods (biscuits, cookies) which fall some distance from this linear approximation, unique cooking time ratio equations and/or cooking time ratio look-up tables for each food could be employed.

Assuming that the ratio of original 240 VAC cooking times to cooking times at different voltages is linear, an equation can be derived from the 20% increase in cooking time used at 208 VAC and the 0% change at the rated voltage point of 240 VAC. FIG. 4 shows this correlation of line voltage to cooking time ratio. However, the optimal cooking time ratio may not be a linear function of line voltage for some food types.

The invention described here solves the aforementioned problems by providing a means to automatically adjust the cooking times in response to the voltage of the electrical supply to the oven when a pre-programmed recipe is initiated. Automation is an important feature, as end-users typically prefer appliances which require as little human interaction as possible.

The automatic cooking system in accordance with one aspect of the present invention works by comparing the present oven supply voltage with that of the oven's rated supply voltage used during the development of the pre-programmed recipes (240 VAC). If the present oven supply voltage is greater than the oven's rated voltage then time is removed from the total cooking time. Similarly, if the present voltage is less than the oven's rated voltage, the cooking time is increased.

The control system in accordance with another aspect of the present invention automatically determines voltage from circuitry which generates an analog signal proportional to the incoming line voltage. This signal is read by an analog-to-digital circuit located in the electronic control microprocessor of the oven.

The time added or subtracted from the total cooking time is determined by the electronic control microprocessor using a time adjustment algorithm.

Certain modifications of the present invention have been discussed above. Other modifications will occur to those practicing in the art of the present invention. For example, line current or line power (a function of voltage and current) could be the parameter used to calculate a corrected cooking time, instead of line voltage.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. An oven for cooking food, comprising:

an electric cooking element:

a power supply line, wherein the power supply line is adapted to be connected to a source of electricity, and is arranged to supply electrical power to the electric cooking element;

means for selecting an automatic cooking procedure having a cooking time;

means for controlling the automatic cooking procedure;

means for sensing a property of the source of electricity; and, means for determining an adjusted cooking time for the automatic cooking procedure before the cooking procedure begins based on the sensed property of the electricity.

2. The oven of claim 1, wherein the electric cooking element is a halogen tungsten lamp.

3. The oven of claim 1, wherein the controlling means is an electronic control microprocessor.

4. The oven of claim 1, wherein the sensing means includes an analog voltage sensor.

5. The oven of claim 1, wherein the sensing means further includes an analog-to-digital convertor.

6. The oven of claim 1, wherein the sensed property is voltage.

7. The oven of claim 1, wherein the sensed property is current.

8. The oven of claim 1, wherein the sensed property is proportional to power.

9. The oven of claim 10, wherein the property is voltage.

10. The oven of claim 10, wherein the keypad is a switch type keypad.

11. The oven of claim 10, wherein the keypad is a capacitive keypad.

12. The oven of claim 10, wherein the pre-programmed algorithm may be overridden by use of the keypad.

13. A method of cooking food with an oven comprising an electric cooking element, a power supply line adapted to be connected to a source of electricity for supplying electrical power to the electric cooking element, and an electronic control microprocessor, the method comprising the steps of:

reading a user-selected pre-programmed cooking algorithm having a cooking time by using the electronic control microprocessor;

executing the pre-programmed cooking algorithm; and automatically determining an adjusted cooking time for the pre-programmed cooking algorithm before cooking begins in response to a property of the source of electricity.

14. The method of claim 13, wherein the property of the electricity is voltage.

15. The method of claim 13, wherein the property of the electricity is current.

16. The method of claim 13, wherein the property of the electricity is power.

17. An oven for cooking food, comprising:

an electric cooking element;

a power supply line, adapted to be connected to a source of electricity, wherein the power supply line is arranged to supply electrical power to the electric cooking element;

a keypad arranged to select an automatic cooking procedure having a cooking time;

a sensor arranged to sense a property of the source of electricity; and an electronic control microprocessor including a pre-programmed algorithm arranged to control the automatic cooking procedure, the electronic control microprocessor being adapted to determine an adjusted cooking time for the automatic cooking procedure before the cooking procedure begins based on the measured voltage of the electricity.

* * * * *